US006875313B2

(12) United States Patent
Bartelmuss et al.

(10) Patent No.: US 6,875,313 B2
(45) Date of Patent: Apr. 5, 2005

(54) APPARATUS FOR A PAPER-MAKING INSTALLATION HAVING AT LEAST ONE WIRE

(76) Inventors: Klaus Bartelmuss, NR. 63, A-8833 Teufenbach (AT); Heinz Bartelmuss, NR. 63, A-8833 Teufenbach (AT)

( * ) Notice: Subject to any disclaimer, the term of this patent is extended or adjusted under 35 U.S.C. 154(b) by 9 days.

(21) Appl. No.: 10/405,849

(22) Filed: Apr. 2, 2003

(65) Prior Publication Data

US 2004/0074623 A1 Apr. 22, 2004

(30) Foreign Application Priority Data

Oct. 17, 2002 (AT) ..... A 1582/2002

(51) Int. Cl.[7] ..... D21F 1/10

(52) U.S. Cl. ..... 162/352; 162/289; 162/351; 162/374

(58) Field of Search ..... 162/352, 289, 162/351, 374

(56) References Cited

U.S. PATENT DOCUMENTS 3,446,702 A * 5/1969 Buchanan ..... 162/374
3,741,866 A * 6/1973 Jud et al. ..... 162/374
5,578,170 A * 11/1996 Erikson et al. ..... 162/203

FOREIGN PATENT DOCUMENTS

| | | |
|---|---|---|
| AT | 389 534 B | 12/1989 |
| EP | 0 350 827 A2 | 1/1990 |
| EP | 0 454 973 A1 | 11/1991 |

* cited by examiner

*Primary Examiner*—Mark Halpern
(74) *Attorney, Agent, or Firm*—Laurence A. Greenberg; Werner H. Stemer; Ralph E. Locher

(57) ABSTRACT

An apparatus for a paper-making installation with at least one wire supports the wire wipes off the water emerging from the paper pulp or paper web on the wire and passing through the wire. The apparatus is formed with a plurality of supporting and wiping elements of ceramic material located at intervals from one another in the direction of movement of the wire. The upper surfaces of the elements come into contact with the wire. A large number of supporting and wiping elements is provided, and they are located in a plurality of rows that extend over the width of the wire. Each row has a plurality of elements.

12 Claims, 4 Drawing Sheets

APPARATUS FOR A PAPER-MAKING INSTALLATION HAVING AT LEAST ONE WIRE

This application claims priority based on application No. 1582/2002, filed in Austria on 17 Oct., 2002.

BACKGROUND OF THE INVENTION

Field of the Invention

The present invention lies in the field of paper manufacturing technology. More specifically, the invention relates to an apparatus for a system having at least one wire (screen) for making paper. In order to support the wire and to wipe off the water emerging from the paper stock or paper web on the wire and passing through the wire, the apparatus is formed with a plurality of supporting and scraping elements of ceramic material located at intervals from one another in the direction of movement of the wire, with whose upper sides the wire comes into contact.

Prior art wire systems of that type have a plurality of strips of ceramic material which are arranged one after another in the direction of movement of the wire. The strips or scrapers extend over the entire width of the wire and their upper sides come into contact with the wire. These strips are used firstly to support the wire and secondly to wipe off from the underside of the wire the water which comes from the paper stock on the wire and which passes through the wire.

In a first region of the wire system, the water contained in the paper pulp passes through the wire in particular owing to the force of gravity. In the following regions, however, in order to extract the water contained in the paper web or the moisture in the paper web, it is necessary to apply vacuum to the wire. For this purpose, suction boxes are provided in the further regions of the wire. By means of the vacuum applied to the wire, the latter is brought into contact with the supporting and wiping strips under great pressure. In order to be able to absorb the forces exerted on the wire in the process, the supporting and wiping strips have to be arranged beside one another at close intervals.

Between the supporting and wiping strips, firstly the water emerging from the wire is led away and, secondly, the vacuum applied by the suction boxes comes into effect on the wire, by means of which the water or the moisture contained in the paper pulp or paper web is extracted. The supporting and wiping strips have to satisfy two conditions in the process, although these are contradictory. On the one hand, these strips should be arranged as close to one another as possible, in order to effect the required support of the wire, in particular in those regions wherein vacuum is applied thereto. On the other hand, the supporting and wiping strips should be located at the greatest possible intervals, in order to achieve sufficient space for the discharge of the water that passes through the wire and, in addition, the greatest possible spaces wherein the vacuum comes into effect on the wire.

SUMMARY OF THE INVENTION

It is accordingly an object of the invention to provide an apparatus for a paper-making installation which overcomes the above-mentioned disadvantages of the heretofore-known devices and methods of this general type and which meets the aforementioned requirements in the best possible way.

With the foregoing and other objects in view there is provided, in accordance with the invention, an apparatus in a paper-making installation having at least one wire, for supporting and scraping the wire. The apparatus comprises:

a multiplicity of supporting and wiping elements having an upper surface of ceramic material for coming into contact with the wire of the paper-making installation and for wiping from the wire water emerging from a paper pulp or paper web supported on the wire and passing through the wire;

the multiplicity of supporting and wiping elements being disposed in a plurality of rows spaced from one another in a direction of movement of the wire, each of the plurality of rows containing a plurality of supporting and wiping elements and extending over an entire width of the wire.

In other words, the objects of the invention are achieved in that a large number of supporting and wiping elements are provided, which are located in a plurality of rows that extend over the width of the wire, there being a plurality of elements in each row.

The large number of supporting and wiping elements arranged beside one another and one after another ensures firstly that the wire is adequately supported, this good support being required in particular in those regions wherein high vacuum forces are exerted on the wire. Secondly, between the large number of supporting and wiping elements arranged beside one another and one after another there are sufficiently many interspaces, through which the water contained in the paper stock or in the paper web passes and wherein the suction forces applied to the wire by the vacuum boxes come into effect on the wire.

The supporting and wiping elements are preferably arranged to be offset with respect to one another in two successive rows in the direction of movement of the wire.

According to a preferred embodiment, a load bearing device, for example in the form of load bearing strips arranged in parallel, is provided, to which the supporting and wiping elements are fixed and from which these elements protrude. In this case, the load bearing device can be fixed to a load bearing frame, wherein the wiping and supporting elements are located. Furthermore, the upper edge of the load bearing frame can be located at least approximately in the area of the upper side of the supporting and wiping elements. This is required in any case when the load bearing frame is associated with a suction box, since this effects the required sealing with respect to the wire. As an alternative to this, the upper edge of the load bearing frame can be located at a distance below the area of the upper side of the supporting and wiping elements. This embodiment is possible when no vacuum is applied to the wire in the region of the supporting and wiping elements.

On their upper sides coming into contact with the wire, the supporting and wiping elements are preferably formed with a wedge-like nose extension which projects forward counter to the direction of movement of the wire. This configuration improves the wiping and scraping action of the elements. In addition, the supporting and wiping elements can be curved convexly on their upper sides.

Other features which are considered as characteristic for the invention are set forth in the appended claims.

Although the invention is illustrated and described herein as embodied in an apparatus for a system having at least one wire for making paper, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
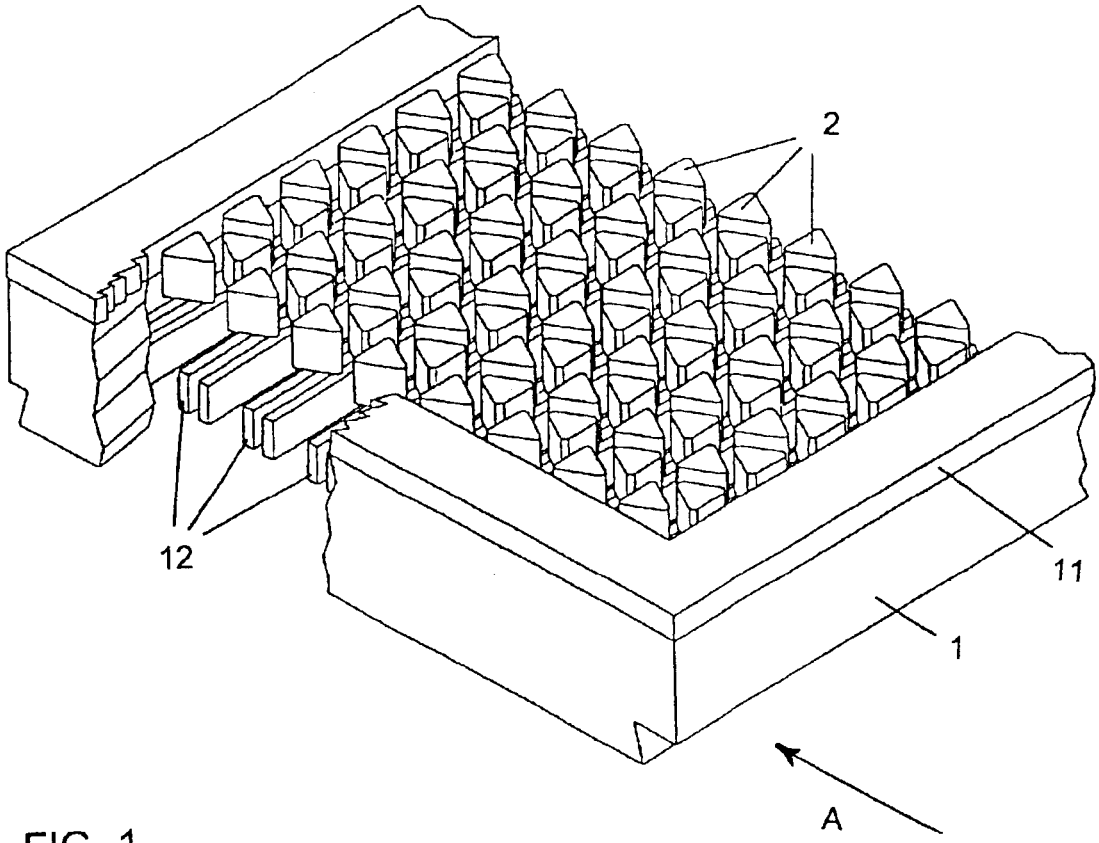
FIG. 1 is a partly broken-away axonometric view of a first embodiment of an apparatus according to the invention.

Referring now to the figures of the drawing in detail and first, particularly, to FIG. 1 thereof, there is shown an apparatus having a load bearing frame 1 which, for example, is intended to be mounted on a suction box. The load bearing frame 1 is formed on its upper side with a contact support 11 of ceramic material, with which a non-illustrated wire of a system for making paper comes into contact. The wire is moved over the load bearing frame 1 in the direction of the arrow A. In addition, the load bearing frame 1 is formed with a plurality of load bearing strips 12, to which upwardly projecting supporting and wiping elements 2 are fixed. The upper surfaces of the supporting and wiping elements 2 are located in the plane of the upper side of the contact support 11.

The load bearing frame 1 and the large number of supporting and wiping elements 2 in this case extend over the entire width of the wire. The supporting and wiping elements 2, which may also be referred to as scrapers or scraper elements 2, are arranged close beside one another and one after another in a large number of rows aligned transversely with respect to the direction of movement A of the wire, there being a very large number of interspaces between the large number of supporting and wiping elements 2 arranged beside one another and one after another, through which interspaces firstly the water emerging from the paper stock or paper web on the wire passes and, secondly, the vacuum exerted on the paper stock or the paper web by the suction box comes into effect. Although, as a result, the effective area of the interspaces between the supporting and wiping elements 2 is very large, as a result of which the passage of the water is not impeded and, in addition, very effective application of vacuum to the wire is ensured, the required support for the wire is ensured owing to the large number of elements 2. In this context, reference is had to the fact that this support is required in particular in those regions of the movement path of the wire wherein a very high vacuum has to be applied to the paper web resting on the wire in order to remove the moisture in the paper web.

In order to achieve a uniform support and wiping action over the width of the wire, the supporting and wiping elements 2 in successive rows in the direction of movement of the wire are arranged to be offset transversely with respect to one another.

Figure 2:
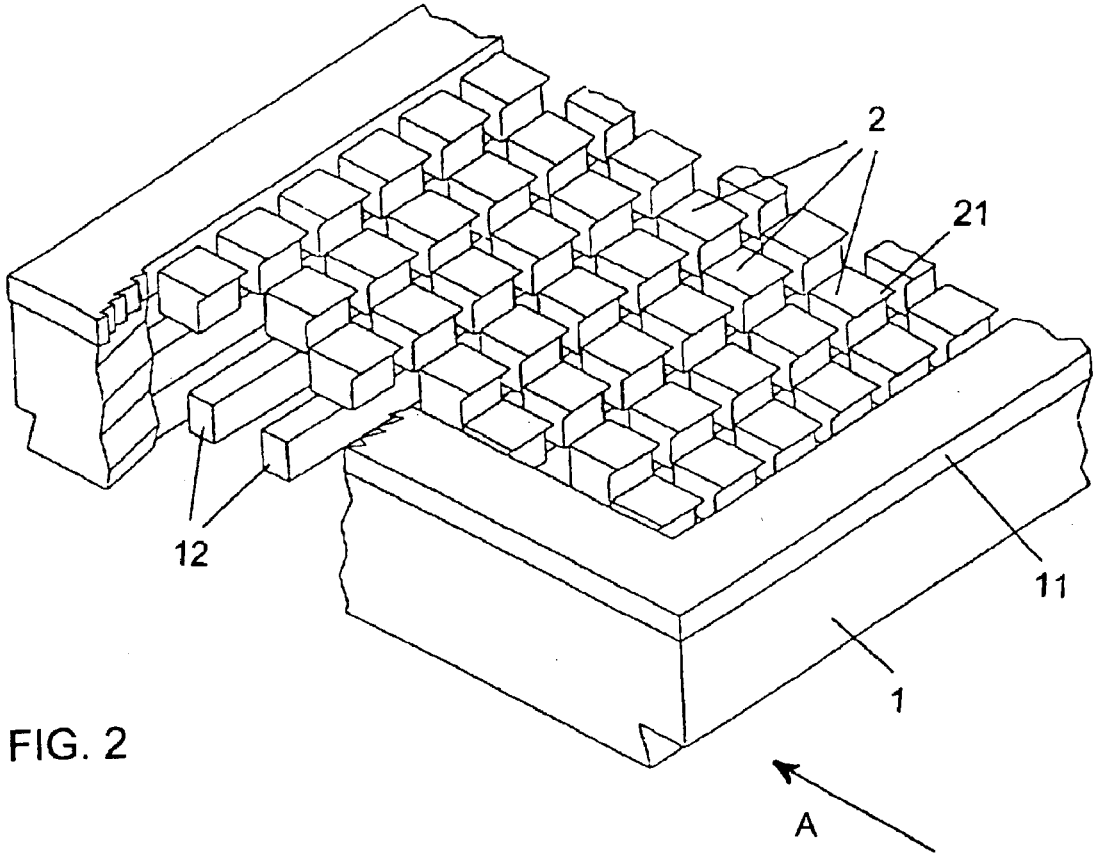
FIG. 2 is a similar perspective view of a second embodiment of the apparatus according to the invention.

The exemplary embodiment illustrated in FIG. 2 of an apparatus according to the invention differs from the exemplary embodiment illustrated in FIG. 1 in that the supporting and wiping elements 2 have a different physical shape. Here, the elements 2 are formed with extensions 21 which taper in a wedge shape counter to the direction of movement A of the wire, by means of which extensions the wiping action in relation to the water passing through the wire is improved.

Figure 3:
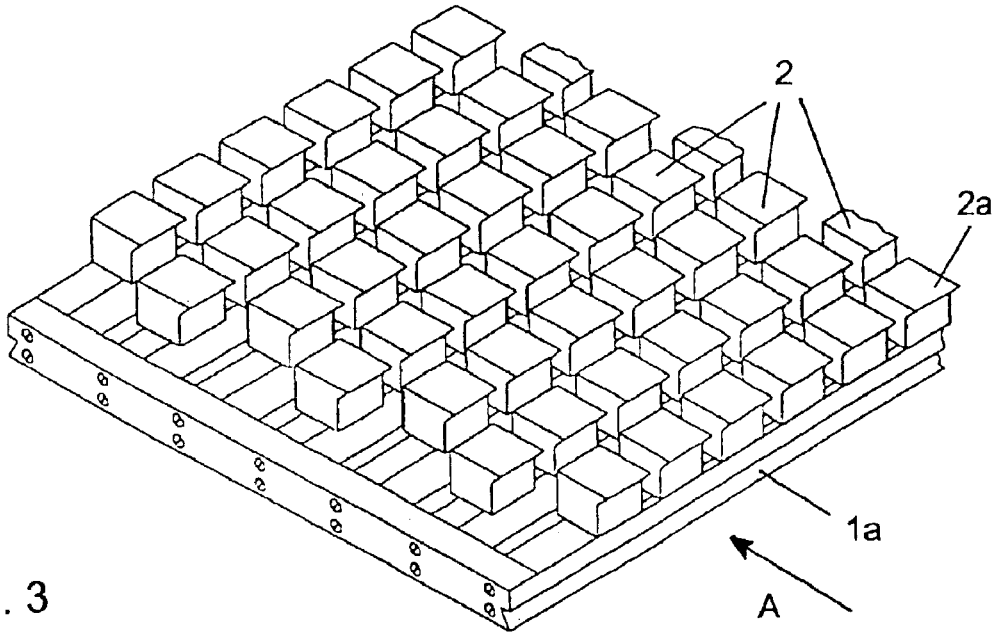
FIG. 3 is a similar perspective view of a third embodiment of the apparatus according to the invention.

The apparatus illustrated in FIG. 3 differs from the apparatus illustrated in FIG. 2 in that the wiping elements 2*a* project beyond the load bearing frame 1*a* and in that the load bearing frame 1*a* is not formed with an upper side that comes into contact with the wire. An apparatus of this type is used when the intention is to achieve only support for the wire and a wiping action, whereas no vacuum is applied to the wire.

Figure 4:
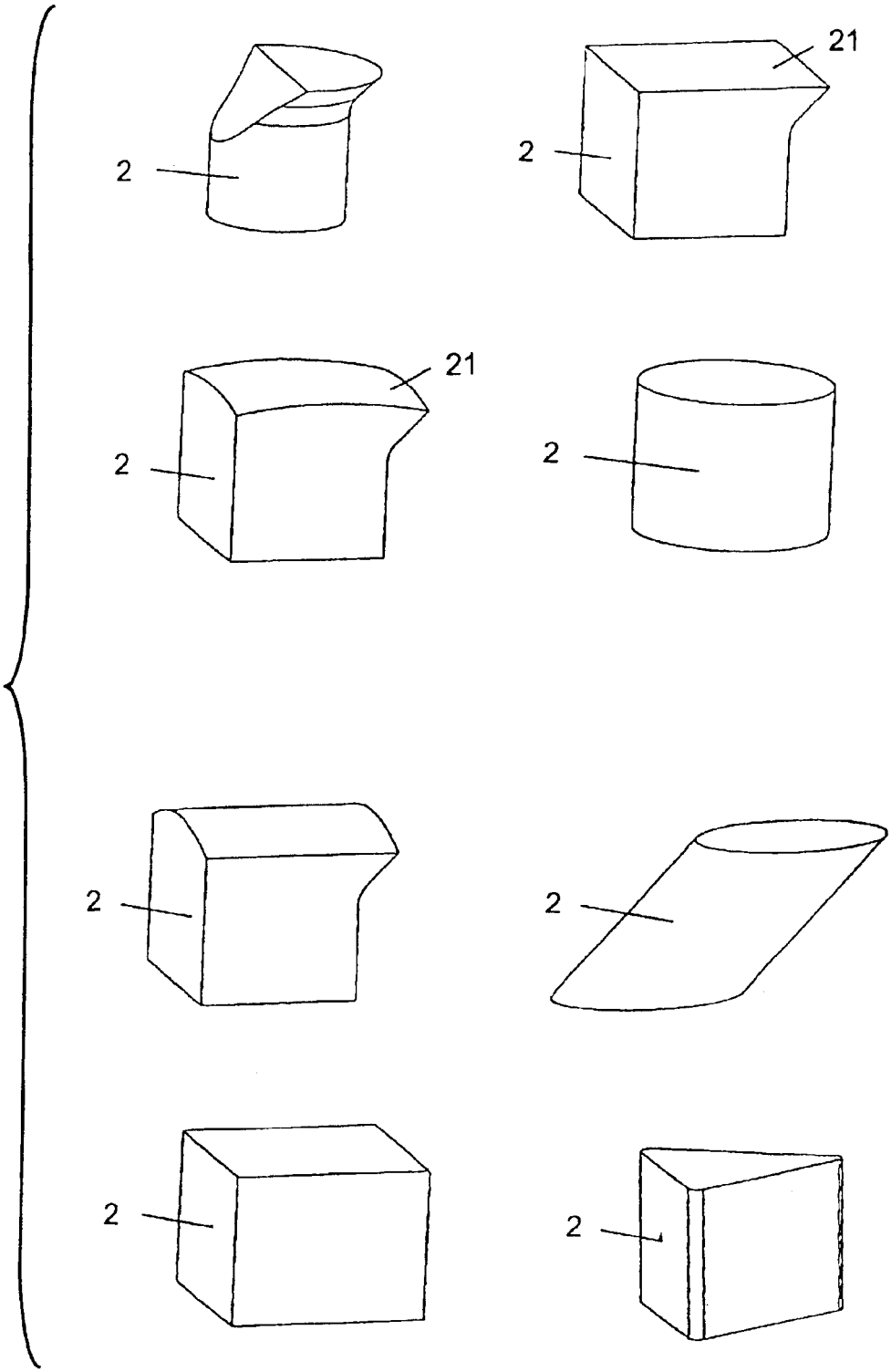
FIG. 4 is a collection of perspective views showing different embodiments of supporting and wiping elements.

Eight different embodiments of supporting and wiping elements 2 are illustrated in FIG. 4. These illustrations show that the supporting and wiping elements 2 can have a large number of designs. These can be formed with flat or with convexly curved surfaces. In addition, they can be provided with extensions 21 projecting counter to the direction of movement of the wire.

Figure 5:
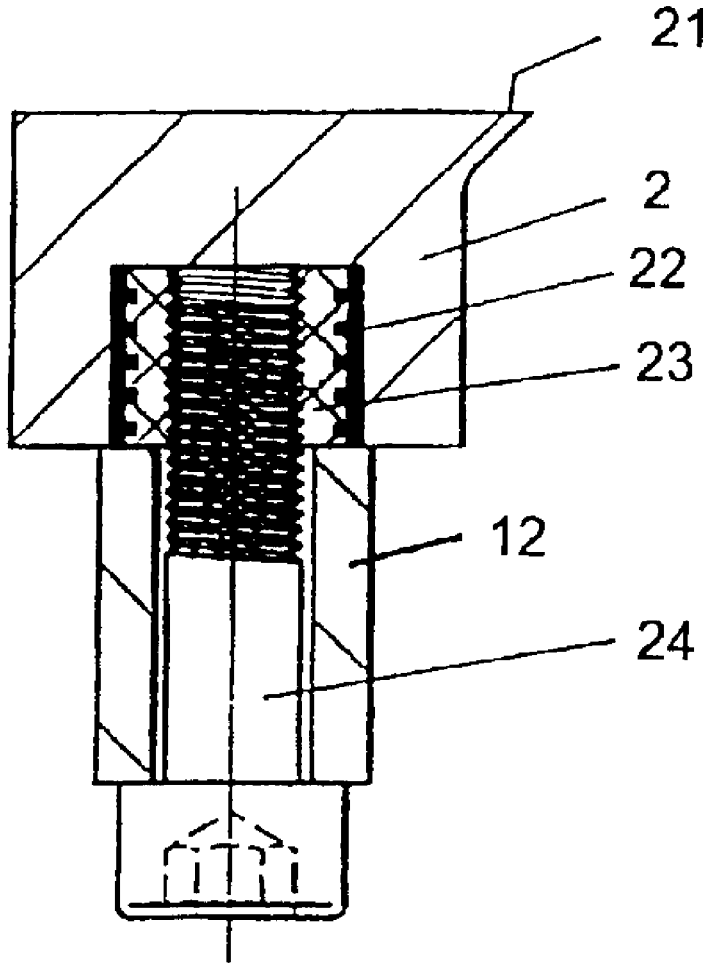
FIG. 5 is an axial section showing a supporting element fixed to a load bearing strip.

With reference to FIG. 5, the supporting and wiping elements 2 can be fixed to the load bearing strips 12 in that the elements 2 are formed on their underside with a blind bore or hole 22, wherein a threaded sleeve 23 is fixed, in particular adhesively bonded. A screw 24 that passes through the load bearing strip 12 is then screwed into the threaded sleeve 23 for the purpose of affixing the element 2 to the load bearing strip 12.

As has been discussed above, a significant feature of the apparatus is found in the teaching that a very large number of supporting and wiping elements 2 is provided, by means of which the required support for the wire is effected and by means of which the water passing through the wire is scraped or wiped off, but a very large area being additionally available to discharge the water and for the action of vacuum on the wire, which permits a very effective application of vacuum.

We claim:

1. In a paper-making installation having at least one wire, an apparatus for supporting and scraping the wire, comprising:

a multiplicity of supporting and wiping elements having an upper surface of ceramic material for coming into contact with the wire of the paper-making installation and for wiping from the wire water emerging from a paper pulp or paper web supported on the wire and passing through the wire;

said multiplicity of supporting and wiping elements being disposed in a plurality of rows spaced from one another in a direction of movement of the wire, each of said plurality of rows containing a plurality of mutually spaced-apart supporting and wiping elements defining free spaces therebetween for conducting water away from the wire and said rows extending over an entire width of the wire.

2. The apparatus according to claim 1, wherein said supporting and wiping elements substantially consist of ceramic material.

3. The apparatus according to claim 1, wherein said supporting and wiping elements in two mutually successive rows in the direction of movement of the wire are offset with respect to one another relative to the direction of movement of the wire.

4. The apparatus according to claim 1, which further comprises a load bearing device for fixedly supporting said supporting and wiping elements, with said supporting and wiping elements projecting from said load bearing device.

5. The apparatus according to claim 4, wherein said load bearing device is formed with a plurality of mutually parallel load bearing strips each supporting said supporting and wiping elements.

6. The apparatus according to claim 4, wherein said load bearing device is fixed to a load bearing frame wherein said wiping and supporting elements are located.

7. The apparatus according to claim 6, wherein said load bearing frame has an upper edge aligned substantially even with said upper surface of each of said supporting and wiping elements.

8. The apparatus according to claim 6, wherein said load bearing frame has an upper edge aligned below said upper surface of each of said supporting and wiping elements.

9. The apparatus according to claim 1, wherein at least some of said supporting and wiping elements are formed with a wedge-shaped extension on said upper surface coming into contact with the wire, and said wedge-shaped extension projects forward counter to the direction of movement of the wire.

10. The apparatus according to claim 1, wherein said upper surface of said supporting and wiping elements is convexly curved.

11. In a paper-making installation having at least one wire, an apparatus for supporting and scraping the wire, comprising:

a multiplicity of supporting and wiping elements having an upper surface of ceramic material for coming into contact with the wire of the paper-making installation and for wiping from the wire water emerging from a paper pulp or paper web supported on the wire and passing through the wire;

said multiplicity of supporting and wiping elements substantially consisting of ceramic material and being disposed in a plurality of rows spaced from one another in a direction of movement of the wire, each of said plurality of rows containing a plurality of supporting and wiping elements defining free spaces therebetween for conducting water away from the wire and extending over an entire width of the wire.

12. In a paper-making installation having at least one wire, an apparatus for supporting and scraping the wire, comprising:

a multiplicity of supporting and wiping elements having an upper surface of ceramic material for coming into contact with the wire of the paper-making installation and for wiping from the wire water emerging from a paper pulp or paper web supported on the wire and passing through the wire;

said multiplicity of supporting and wiping elements being disposed in a plurality of rows spaced from one another in a direction of movement of the wire, each of said plurality of rows containing a plurality of spaced-apart supporting and wiping elements defining free spaces therebetween for conducting water away from the wire and said rows extending over an entire width of the wire, and said supporting and wiping elements in two mutually successive rows in the direction of movement of the wire being offset with respect to one another relative to the direction of movement of the wire.

* * * * *